US006874422B2

(12) United States Patent
Heeke

(10) Patent No.: US 6,874,422 B2
(45) **Date of Patent: *Apr. 5, 2005**

(54) HERMETICALLY SEALED ELECTRICAL FEED-THROUGH DEVICE WITH AN OVAL-CROSS-SECTIONED ISOLATED PIN IN A CIRCULAR GLASS SEAL

(75) Inventor: Neil Heeke, Golden, CO (US)

(73) Assignee: Schott Glas, Mainz (DE)

( * ) Notice: Subject to any disclaimer, the term of this patent is extended or adjusted under 35 U.S.C. 154(b) by 275 days.

This patent is subject to a terminal disclaimer.

(21) Appl. No.: 10/279,490

(22) Filed: Oct. 21, 2002

(65) Prior Publication Data

US 2004/0079544 A1 Apr. 29, 2004

(51) Int. Cl.[7] ..... F42B 5/145; F42C 11/00; F42C 19/06; F42C 19/12

(52) U.S. Cl. ..... 102/202.12; 102/202; 102/202.5; 102/202.9

(58) Field of Search ..... 102/202.9, 202.12, 102/202; 361/247, 302; 428/621; 174/50.56; 280/737, 741; 65/36

(56) References Cited

U.S. PATENT DOCUMENTS

| | | | | | |
|---|---|---|---|---|---|
| 372,046 | A | * | 10/1887 | Stuart | 102/202.9 |
| 4,430,376 | A | | 2/1984 | Box | 428/174 |
| 4,648,319 | A | * | 3/1987 | Westerlund et al. | 102/202.12 |
| 4,678,358 | A | | 7/1987 | Layher | 403/28 |
| 4,788,382 | A | | 11/1988 | Ahearn et al. | 174/52.4 |
| 5,157,831 | A | * | 10/1992 | Wang et al. | 29/876 |
| 5,243,492 | A | | 9/1993 | Marquit et al. | 361/247 |
| 5,367,125 | A | * | 11/1994 | Viret et al. | 174/52.4 |
| 5,556,132 | A | * | 9/1996 | Sampson | 280/741 |
| 5,709,724 | A | | 1/1998 | Naugler et al. | 65/59.4 |
| 5,772,243 | A | | 6/1998 | Green et al. | 280/741 |
| 6,274,252 | B1 | | 8/2001 | Naugler et al. | 428/621 |
| 6,446,557 | B1 | * | 9/2002 | Lubbers | 102/202.9 |

FOREIGN PATENT DOCUMENTS

| | | | | |
|---|---|---|---|---|
| FR | 2560983 A1 | * | 9/1985 | F42C/19/12 |
| FR | 2560984 A1 | * | 9/1985 | F42B/3/14 |

* cited by examiner

*Primary Examiner*—Michael J. Carone
*Assistant Examiner*—Daniel L. Greene, Jr.
(74) *Attorney, Agent, or Firm*—Michael J. Striker

(57) ABSTRACT

The hermetically sealed electrical feed-through device has a circular metal disk (11, 21) with a conductive isolated pin (13, 23) hermetically sealed in a through-going circular opening (O, O') by a glass seal (17, 27) and a conductive ground pin (15, 25) connected with a rear side of the metal disk (11, 21) adjacent to the through-going circular opening and extending approximately parallel to the isolated pin. The isolated pin (13, 23) has an oval or elliptical section (13*a*, 23*a*) extending through the glass seal (17, 27), whereby different bridge wires of different lengths are connectable on the front side of the metal disk between the front surface of the metal disk and the isolated pin (13, 23). In one embodiment the pins are straight and the through-going circular opening is offset in the metal disk; in another embodiment the pins are bent and the through-going circular opening (O,O') is centrally positioned in the metal disk (11,21).

10 Claims, 2 Drawing Sheets

HERMETICALLY SEALED ELECTRICAL FEED-THROUGH DEVICE WITH AN OVAL-CROSS-SECTIONED ISOLATED PIN IN A CIRCULAR GLASS SEAL

CROSS-REFERENCES

The present invention contains subject matter in common with a co-pending U.S. Patent Application entitled: HERMETICALLY SEALED ELECTRICAL FEED-THROUGH DEVICE WITH A STRAIGHT ISOLATED PIN IN AN OFFSET OVAL GLASS SEAL and another co-pending U.S. Patent Application entitled: HERMETICALLY SEALED ELECTRICAL FEED-THROUGH DEVICE WITH A BENT ISOLATED PIN IN A CIRCULAR GLASS SEAL, filed on or about the same time as the present application.

BACKGROUND OF THE INVENTION

1. Field of the Invention

The present invention relates to a hermetically sealed electrical feed-through device, especially for an initiator or squib of an air bag igniter.

2. Description of the Related Art

Air bag systems used for protecting the passengers of a motor vehicle during a collision include an inflatable bag mounted in the dashboard or steering wheel, gas generators for the explosive generation of gas to inflate the bag, acceleration sensors to generate an electrical signal indicative of a collision and an igniter responsive to the acceleration sensors for ignition of a trigger charge in a hollow chamber that, in turn, ignites a main charge to produce the gas that inflates the bag.

The igniter for an air bag system comprises a so-called header or squib. The squib or header, as described for example in U.S. Pat. No. 5,243,492 and U.S. Pat. No. 5,772,243, comprises a hermetically sealed electrical feed-through device for supplying a current into the hollow chamber containing the trigger charge and a thin bridge wire electrically connected across the electrical feed-through device. The bridge wire ignites the trigger charge when a sufficient electrical current is passed through it via the feed-through device. Hermetically sealed electrical feed-through devices are also used for other types of devices.

In methods of manufacturing the hermetically sealed electrical feed-through devices of the prior art, as described in U.S. Pat. No. 5,709,724, U.S. Pat. No. 6,274,252, U.S. Pat. No. 5,243,492, U.S. Pat. No. 5,157,831, U.S. Pat. No. 4,678,358 and U.S. Pat. No. 4,430,376, a metal isolator body or plug is provided with a circular through-going opening or a metal eyelet is provided with a circular cavity. A conductive pin, called the isolated pin, is hermetically sealed in the through-going opening or cavity by means of a glass-to-metal seal.

Glass-to-metal seals may be of the compression variety, in which advantage is taken of the difference in the thermal expansion properties of metal and glass, or may be due to molecular bonding, as described in U.S. Pat. No. 5,709,724 and U.S. Pat. No. 6,274,252.

A hermetically sealed feed-through device is made with a glass-to-metal compression seal by cutting an appropriately sized glass preform having a suitable coefficient of thermal expansion with a central hole, arranging the glass preform in a through-going opening in a metal disk or in a cavity in a metal eyelet, inserting the conductive isolated pin in the hole in the preform, heating the assembly to an elevated temperature over the softening point of the glass perform and then cooling the entire assembly, whereby the metal disk or eyelet contracts more than the glass. A ground pin may be connected to the metal disk or the eyelet approximately parallel to the isolated pin as described in U.S. Pat. No. 5,243,492.

The isolated pin and/or the ground pin may also be provided with a noble metal coating to protect against corrosion, as described in U.S. Pat. Nos. 4,788,382 and 5,157,831.

The resulting electrical feed-through devices can be used to make the headers or squibs for the air bag igniter, for example, by connecting the bridge wire across the glass seal between the isolated pin on the front side of the electrical feed-through device and the body of the eyelet or metal disk.

The conductive pins in the prior art electrical feed-through devices are circular cross-sectioned and the through-going opening or cavity in the prior art metal ring or eyelet is circular. Disadvantageously only bridge wires of a comparatively narrow range of lengths can thus be connected across the front side of the electrical feed-through device to make a squib or initiator, e.g. for an air bag, because the isolated pin is placed centrally in the through-going opening in the metal ring or eyelet during assembly. Thus different embodiments of the electrical feed-through devices with different sized through-going openings and different diameter isolated pins must be manufactured e.g. for different air bag system manufacturers or for different initiator or squib manufacturers. This results in comparatively large manufacturing costs including storage, distribution and fixturing expenses, because of the various different types of hermetically sealed electrical feed-through devices for the different initiators.

SUMMARY OF THE INVENTION

It is an object of the present invention to provide an improved hermetically sealed electrical feed-through device, especially for an initiator or squib for an air bag ignition system, which does not suffer from the above-described disadvantages.

It is also an object of the present invention to provide a universal hermetically sealed electrical feed-through device for an initiator or squib for an air bag inflation system of the above-described type having at least one bridge wire, that accommodates a greater range of bridge wire lengths, so that different manufacturers of squibs or initiators having different bridge wire requirements can use the same embodiment of the electrical feed-through device according to the invention.

It is another object of the invention to provide a hermetically sealed electrical feed-through device of the above-described type in which a conductive isolated pin is sealed in a through-going opening by means of a glass seal, in which strain distribution is uniform throughout the glass seal.

According to the invention a hermetically sealed electrical feed-through device, especially for a squib or header of an air bag igniter, comprises an electrically conductive body with a through-going circular opening and having front side and a rear side;

an electrically conductive isolated pin hermetically sealed centrally in the through-going circular opening by means of a glass seal, so that the isolated pin extends outward from the rear side of the electrically conductive body and so that one end of the isolated pin is accessible from or exposed on the front side of the electrically conductive body; and an electrically conductive ground pin connected with the rear side of the electrically conductive body adjacent to the through-going circular opening, the electrically conductive ground pin extending outward from the rear side of the electrically conductive body approximately parallel to the isolated pin;

wherein the isolated pin comprises an oval or elliptical section extending through the glass seal from the rear side of the electrically conductive body to the one end of the isolated pin, the oval or elliptical section having an oval or elliptical transverse cross-section, whereby different bridge wires of different lengths are connectable between the front side of the electrically conductive body and the one end of the isolated pin accessible from or exposed on the front side of the electrically conductive body.

The electrical feed-through device according to the invention has the great advantage that it permits a wider range of bridge wire lengths for one or more bridge wires connected across its front side. The manufacture of a single type of electrical feed-through device thus accommodates the needs of a larger number of different manufacturers who use the electrical feed-through devices to e.g. manufacture squibs or initiators for air bag inflation systems. A lower price for the feed-through device results because of the higher volume due to a reduction in the required number of different embodiments.

In addition, the same length bridge wire can advantageously be welded in all four quadrants of the glass seal. Double bridge wires can easily be welded simultaneously. Furthermore the symmetrical shape of the seal area produces balanced strain distribution in the glass.

In various embodiments of the invention the ground pin is metal, has a circular transverse cross-section and is shortened relative to the isolated pin so that free ends of the pins are approximately the same distance from the rear side of the circular metal disk. One end of the isolated pin, the glass seal and the front side of the circular metal disk each have respective front surfaces that are approximately even with each other or approximately coplanar. Also raw material costs will be reduced because cold forming or metal injection molding can be used for the conductive body or eyelet.

In one preferred embodiment the electrically conductive body is a circular metal disk or metal ring, the through-going circular opening is positioned centrally in and through the circular metal disk. In this embodiment the ground pin and the isolated pin are both angular or bent pins.

In another preferred embodiment the electrically conductive body is a circular metal disk, the through-going circular opening is offset from a center of the circular metal disk, and the ground pin and the isolated pin are both straight pins. With proper orientation additional stress reductions can be provided in the glass.

In both preferred embodiments the isolated pin consists of the oval or elliptical and a remaining section having a circular transverse cross-section. However the entire isolated pin may have an elliptical or oval cross-section.

BRIEF DESCRIPTION OF THE SEVERAL VIEWS OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 1:
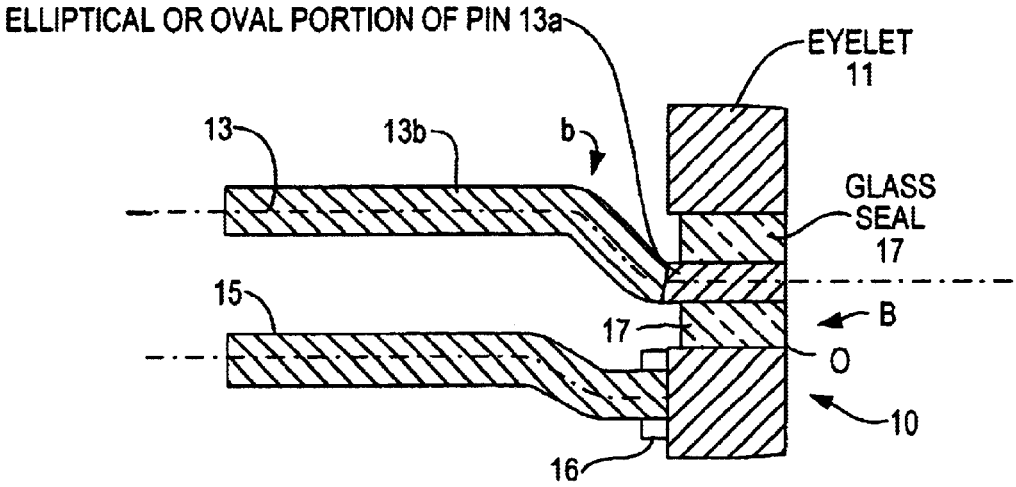
FIG. 1 is a longitudinal cross-sectional view through a first embodiment of the electrical feed-through device according to the invention taken along the section line A—A in FIG. 2.

Two embodiments of the hermetically sealed electrical feed-through are shown in the drawing. The first embodiment is shown in FIGS. 1 and 2; the second, in FIGS. 3 and 4.

Figure 2:
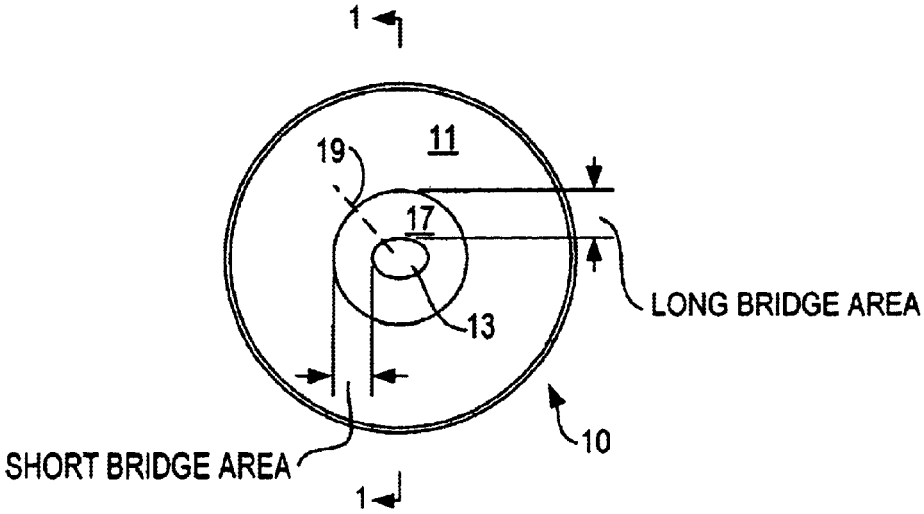
FIG. 2 is a front elevation view of the electrical feed-through device shown in FIG. 1 in the direction indicated by the arrow B in FIG. 1.

FIGS. 1 and 2 show a bent pin embodiment 10 of the electrical feed-through device. The electrical feed-through device in this embodiment comprises a circular metal disk 11 provided with a centrally positioned, circular through-going opening O. An angular or bent isolated pin 13 is sealed in the central circular opening O in the circular metal disk 11 by means of glass seal 17. An angular or bent ground pin 15 extends from the back of the circular metal disk 11 in an axial direction B indicated e.g. with the arrow in FIG. 1 shown on the front side of the metal disk 11 in FIG. 1. Both the isolated pin 13 and the ground pin 15 are made of an electrically conductive metal, such as nickel-iron, and may be plated with a noble metal coating, such as a palladium or gold coating, to protect against corrosion.

The angular isolated pin 13 consists of an oval or elliptical front portion or section 13*a* and a circular cross-sectioned rear portion or section 13*b*. The oval or elliptical front portion 13*a* has an oval or elliptical transverse cross-section. In the embodiment shown in FIGS. 1 and 2 the oval or elliptical portion 13*a* only extends through the glass seal 17, while the remainder of the pin has a circular transverse cross-section. However in other unshown embodiments the entire isolated pin 13 can have the oval or elliptical transverse cross-section. The circular cross-sectioned portion 13*b* of the angular isolated pin 13 includes a single bend b.

The angular isolated pin 13 and the angular ground pin 15 both have the single bend b and are shaped so that they are approximately parallel to each other. The ground pin 15 is shorter than the isolated pin 13 by an amount such that the free ends of both are approximately the same distance from the metal disk 11 in the embodiment shown in the drawing. The end of the isolated pin 13 inserted in the glass seal 17 is more or less even or flush with the front surface of the metal disk or eyelet 11 and the glass seal 17 in the embodiment shown in the drawing.

Cutting and bending steps form the angular isolated pin 13 with the oval or elliptical portion 13*a* during manufacture. The ground pin 15 may also have an oval or elliptical portion or section, or it can be entirely circular cross-sectioned. The ground pin 15 is attached to the metal disk 11 with braze ring 16 and is also called the braze pin.

In use as part of an igniter a fine metal bridge wire 19 (shown with dashed lines in FIGS. 1 and 2) extends across the front of the eyelet 11 and electrically connects the isolated pin 13 with the ground pin 15 via the body of the metal disk. The area across the front of the circular metal disk 11 where the fine metal wire 19 is connected is called the bridge area, since the fine bridge wire 19 bridges the gap between the two pins. However the fine bridge wire 19 is not part of the electrical feed-through. The electrical feed-through device is marketed separately without the fine bridge wire 19 to a manufacturer of the igniter. Conceivably the electrical feed-through device could have other applications besides air bag igniters.

As shown in FIG. 2, there is a long bridge area in which the distance across the glass seal 17 is greatest on the surface of the header assembly. There is also a short bridge area on the surface of the header assembly in which the distance across the glass seal 17 is the least. In this way the same hermetically sealed electrical feed-through device can be marketed to different manufacturers that require different lengths of the fine bridge wire 19 in their igniter devices. Thus the hermetically sealed electrical feed-through device of the present invention is advantageously a universal feed-through device for air bag igniters of different manufacturers. However the same length bridge wire can be welded in all four quadrants of the glass seal. Double bridge wires can be easily welded at the same time.

Figure 3:
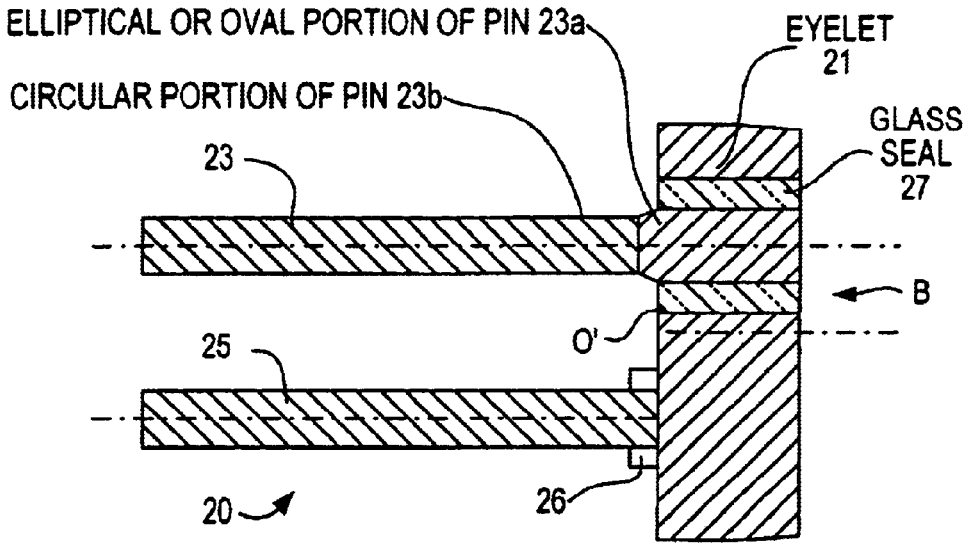
FIG. 3 is a longitudinal cross-sectional view through a second embodiment of the electrical feed-through device according to the invention taken along the section line A—A in FIG. 4.
Figure 4:
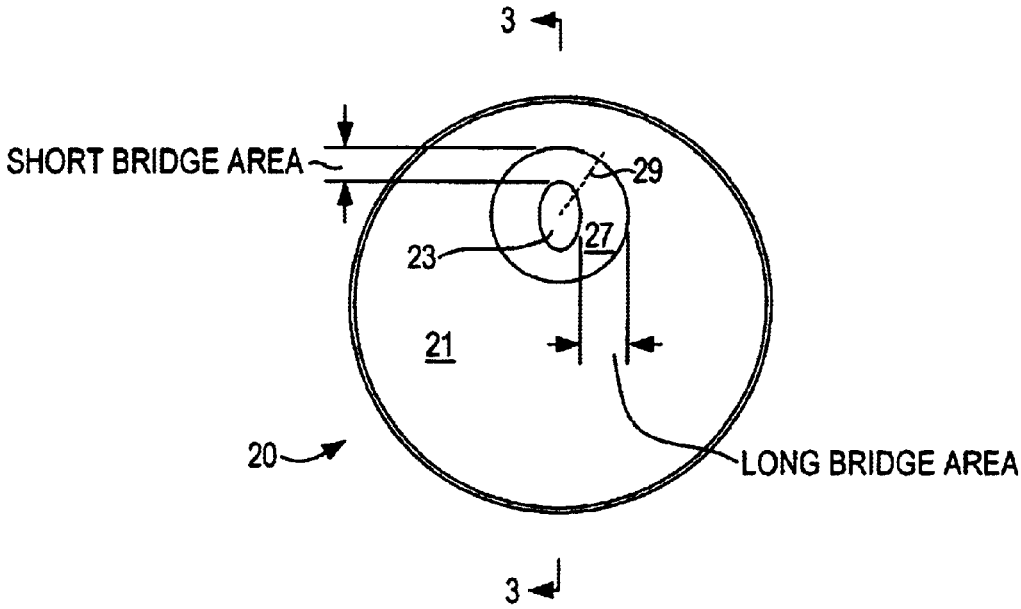
FIG. 4 is a front elevation view of the electrical feed-through device shown in FIG. 3 in the direction indicated by the arrow B in FIG. 3.

FIGS. 3 and 4 show the straight pin embodiment 20 of the hermetically sealed electrical feed-through device. The electrical feed-through device in this embodiment comprises a circular metal disk 21 with a through-going circular opening O' offset from the center of the circular metal disk 21, a straight isolated pin 23 sealed in the offset, circular hole O' in the circular metal disk 21 with a glass seal 27 and a straight ground pin 25 extending from the back or rear of the circular metal disk 21 in an axial direction B indicated e.g. with the arrow in FIG. 3 shown on the front side of the metal disk 21 in FIG. 1. Both the isolated pin 23 and the ground pin 25 are made of an electrically conductive metal, such as nickel-iron, and may be plated with another metal, especially a noble metal, such as palladium or gold, to provide corrosion protection.

The straight isolated pin 23 consists of an oval or elliptical front portion 23*a* and a circular cross-sectioned rear portion 23*b*. The oval or elliptical front portion 23*a*, as in the previous embodiment, has an oval or elliptical transverse cross-section. In the embodiment shown in FIGS. 3 and 4 the oval or elliptical portion 23*a* only extends through the glass seal 27, but the remainder of the isolated pin 23 has a circular cross-section.

The isolated pin 23 and the ground pin 25 extend from the rear of the metal disk 21 and are parallel to each other. The ground pin 25 is shorter than the isolated pin 23, so that the free ends of both pins are approximately the same distance from the rear of the metal disk 21. The end of the isolated pin 23 inserted in the glass seal 27 is more or less even or flush with the front surface of the metal disk 21 and the glass seal 27 in the embodiment shown in the drawing.

Cutting and bending steps form the straight isolated pin 23 with the oval or elliptical portion 23*a* during manufacture. The straight ground pin 25 may also have an oval or elliptical portion or section, or it can be entirely circular cross-sectioned. The ground pin 25 is attached to the circular metal disk 21 with braze ring 26 and is also called the braze pin.

In use as part of an igniter a fine metal bridge wire 29 (shown with dashed lines in FIGS. 3 and 4) extends across the front of the circular metal disk 21 and electrically connects the isolated pin 23 with the ground pin 25. The area across the front of the metal disk 21 where the fine metal bridge wire 29 is connected is called the bridge area, since the fine bridge wire 29 bridges the gap between the two pins.

However the fine bridge wire 29 is not part of the present invention, and thus is shown with dashed lines. The electrical feed-through device is marketed separately without the fine bridge wire 29 to various manufacturers of the initiator or squib for the air bag inflation device. Conceivably the electrical feed-through device of the present invention could have other applications besides air bag igniters.

In this second embodiment, like the first embodiment, the same hermetically sealed electrical feed-through device can be marketed to different manufacturers that require different lengths of the fine bridge wire 29 in their igniter devices. Thus the hermetically sealed electrical feed-through device of the present invention is advantageously a universal feed-through device for air bag igniters of different manufacturers. In addition, the same length bridge wire can be welded in all four quadrants of the glass seal. Double bridge wires can be easily welded at the same time.

The glass seal 17, 27 of the hermetically sealed electrical feed-through device of the present invention may be made by the methods disclosed in background section of the invention, especially those disclosed in U.S. Pat. No. 6,274,252 and U.S. Pat. No. 5,709,724. The inventive improvements in the feed-through devices claimed below reside primarily in the geometries selected for the pin cross-sections and/or the through-going openings.

While the invention has been illustrated and described as embodied in a hermetically sealed electrical feed-through device, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A hermetically sealed electrical feed-through device comprising an electrically conductive body (11,21) with a through-going circular opening (O,O'), said electrically conductive body having a front side and a rear side;

an electrically conductive isolated pin (13, 23) hermetically sealed centrally in said through-going circular opening (O,O') by means of a glass seal (17, 27), so that said isolated pin (13, 23) extends outward from said rear side of said electrically conductive body and so that one end of the isolated pin is accessible from or exposed on said front side of said electrically conductive body; and an electrically conductive ground pin (15, 25) connected with the rear side of the electrically conductive body (11, 21) adjacent to said through-going circular opening, said electrically conductive ground pin (15, 25) extending outward from the rear side of the electrically conductive body (11,21) approximately parallel to the isolated pin;

wherein said isolated pin (13, 23) comprises an oval or elliptical section (13*a*, 23*a*) extending through said glass seal (17, 27) from said rear side of said electrically conductive body to said one end of said isolated pin, said oval or elliptical section (13*a*, 23*a*) having an oval or elliptical transverse cross-section, whereby different bridge wires of different lengths are connectable between the front side of the said electrically conductive body (11, 21) and the one end of the isolated pin accessible from or exposed on the front side of the electrically conductive body.

2. The hermetically sealed electrical feed-through device as defined in claim 1, wherein said electrically conductive body (11) is a circular metal disk, said through-going circular opening (O) is positioned centrally in said circular metal disk, and said ground pin and said isolated pin are each an angular or bent pin having a bend (b).

3. The hermetically sealed electrical feed-through device as defined in claim 2, wherein said ground pin (15) is metal and has a circular transverse cross-section and is shortened relative to said isolated pin (13) so that free ends of said isolated pin and said ground pin are approximately the same distance from the rear side of said circular metal disk.

4. The hermetically sealed electrical feed-through device as defined in claim 2, wherein said one end of said isolated pin (13), said glass seal (17) and said front side of said circular metal disk have respective front surfaces that are approximately even with each other or approximately coplanar.

5. The hermetically sealed electrical feed-through device as defined in claim 1, wherein said electrically conductive body (21) is a circular metal disk, said through-going circular opening (O') is offset from a center of said circular metal disk, and said ground pin and said isolated pin are both straight.

6. The hermetically sealed electrical feed-through device as defined in claim 5, wherein said ground pin (25) is metal, has a circular transverse cross-section and is shortened relative to said isolated pin (23), so that free ends of said isolated pin and said ground pin are approximately an identical distance from the rear side of said circular metal disk.

7. The hermetically sealed electrical feed-through device as defined in claim 5, wherein said one end of said isolated pin (23), said glass seal (27) and said front side of said circular metal disk have respective front surfaces that are approximately even with each other or approximately coplanar.

8. The hermetically sealed electrical feed-through device as defined in claim 1, wherein said isolated pin (13, 23) consists of said oval or elliptical section (13*a*, 23*a*) and a remaining section (13*b*, 23*b*), said remaining section having a circular transverse cross-section.

9. The hermetically sealed electrical feed-through device as defined in claim 1, wherein said isolated pin (13, 23) has said oval or elliptical transverse cross-section from said one end accessible from the front side of the electrically conductive body to a free end thereof.

10. The hermetically sealed electrical feed-through device as defined in claim 2 or 5, wherein said ground pin (15, 25) is connected to said circular metal disk by brazing or is a braze pin.

* * * * *